US008544602B2

(12) United States Patent
Xu et al.

(10) Patent No.: US 8,544,602 B2
(45) Date of Patent: Oct. 1, 2013

(54) SAFETY PROTECTION DEVICE FOR ROOF CONSTRUCTION OF TRAIN BODY ASSEMBLY

(75) Inventors: Xiaoyang Xu, Jilin (CN); Xiuqin Gao, Jilin (CN)

(73) Assignee: Changchun Railway Vechicles Co., Ltd., Jilin (CN)

( * ) Notice: Subject to any disclaimer, the term of this patent is extended or adjusted under 35 U.S.C. 154(b) by 0 days.

(21) Appl. No.: 13/310,411

(22) Filed: Dec. 2, 2011

(65) Prior Publication Data

US 2012/0067669 A1 Mar. 22, 2012

Related U.S. Application Data

(63) Continuation of application No. PCT/CN2010/074803, filed on Jun. 30, 2010.

(30) Foreign Application Priority Data

Sep. 11, 2009 (CN) ..... 2009 2 0094340

(51) Int. Cl.
*A62B 35/00* (2006.01)
*B66F 11/00* (2006.01)

(52) U.S. Cl.
USPC ..... 182/3

(58) Field of Classification Search
USPC ..... 182/3, 45
See application file for complete search history.

(56) References Cited

U.S. PATENT DOCUMENTS

| | | | | |
|---|---|---|---|---|
| 4,572,328 | A | 2/1986 | Benko | 182/1 |
| 4,679,657 | A | 7/1987 | Bennett et al. | 182/113 |
| 5,042,612 | A | 8/1991 | Bennett et al. | 182/1 |
| 5,522,472 | A | 6/1996 | Shuman, Jr. et al. | 182/3 |
| 5,701,704 | A * | 12/1997 | Landes | 52/64 |
| 6,502,663 | B2 * | 1/2003 | Ecker et al. | 182/3 |
| 2002/0148680 | A1 * | 10/2002 | Lee | 182/3 |

FOREIGN PATENT DOCUMENTS

| | | |
|---|---|---|
| CN | 201082948 Y | 7/2008 |
| CN | 201484440 U | 5/2010 |
| WO | WO03/048024 A1 | 6/2003 |

OTHER PUBLICATIONS

International Search Report of international Application No. PCT/CN2010/074803, dated Oct. 8, 2010.

* cited by examiner

*Primary Examiner* — Alvin Chin Shue
(74) *Attorney, Agent, or Firm* — J.C. Patents

(57) ABSTRACT

A safety protection device for the roof construction of a train body assembly comprises two arch bridge shaped transverse walking boards and a safety rope, wherein the safety rope is fixed between the span of the two arch bridge shaped transverse walking boards. The invention has the following benefit effects: the safety for the worker walking and working on the roof can be guaranteed since the worker walks up to the roof through the arch bridge shaped transverse walking boards and ties the other end of a safety belt which is tied on him to the safety rope.

2 Claims, 2 Drawing Sheets

SAFETY PROTECTION DEVICE FOR ROOF CONSTRUCTION OF TRAIN BODY ASSEMBLY

CROSS-REFERENCE TO RELATED APPLICATIONS

This application is a continuation of the international application No. PCT/CN2010/074803 filed on Jun. 30, 2010, which claims the priority benefits of china application No. 200920094340.X filed on Sep. 11, 2009. The content of those prior applications are hereby incorporated by reference in its entirety.

FIELD OF THE TECHNOLOGY

The invention belongs to the technical field of the manufacture of a track passenger train, and relates to a safety protection device for the roof operation during the construction of a train body assembly of a track passenger train.

BACKGROUND

In the prior art, during the construction of the train body assembly of a track passenger train, a worker climbs to the roof of the train without any special safety protection devices, the roof of the train is a smooth surface, and the worker is in danger of falling off, so that the high-altitude operation has potential safety hazard.

SUMMARY

The purpose of the invention is to provide a safety protection device for the roof construction of a train body assembly, which can guarantee the safety of the worker who climbs to the roof to operate during the construction of the train body assembly, and eliminate the potential safety hazard of the high-altitude operation, and improve the quality and efficiency of the construction of the train body assembly.

In order to achieve the above purposes, the invention provides a safety protection device for the roof construction of the train body assembly, which comprises two arch bridge shaped transverse walking boards and a safety rope, wherein the safety rope is fixed between the span of the two arch bridge shaped transverse walking boards.

A rope straining device is fixed in the middle of each of the arch bridge shaped transverse walking boards, the two ends of the safety rope are connected with two rope straining devices, respectively, and the safety rope is strained and straightened by the two rope straining devices.

The invention has the following positive effects: the safety of the worker walking and working on the roof can be guaranteed since the worker walks up to the roof through the arch bridge shaped transverse walking boards and ties the other end of a safety belt that is tied on him to the safety rope.

DETAILED DESCRIPTION

Figure 1:
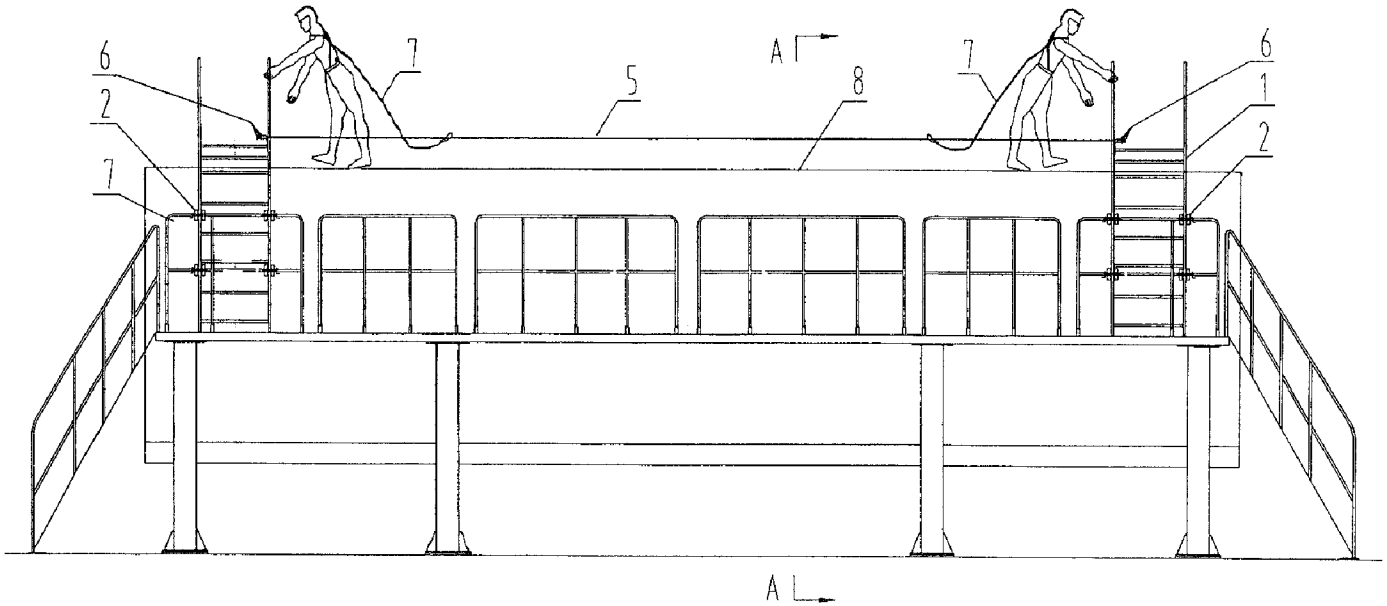
FIG. 1 is a schematic structural diagram of the invention.
Figure 2:
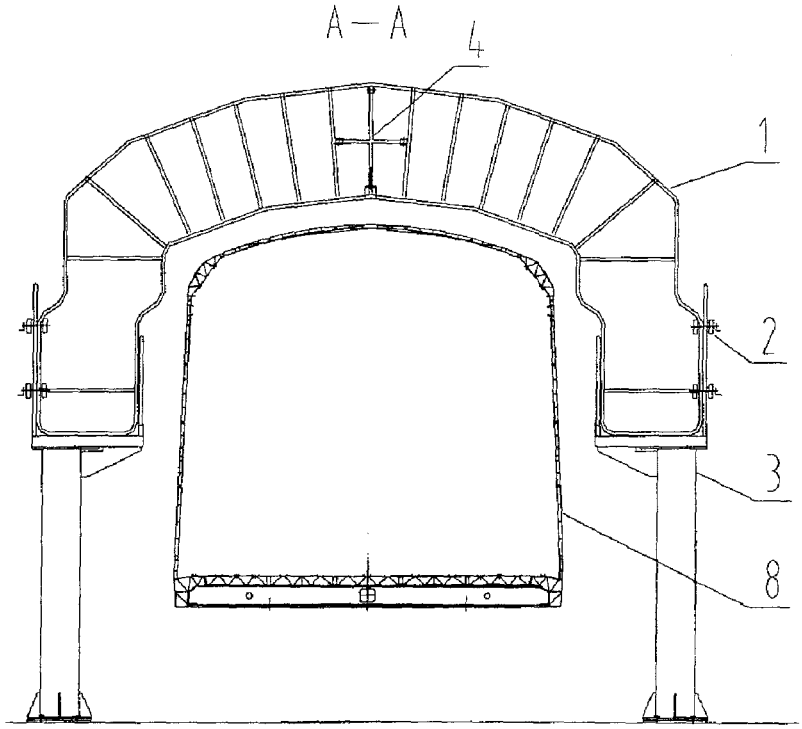
FIG. 2 is the cross-section diagram along the A-A line in FIG. 1.

Referring to FIG. 1 and FIG. 2, two arch bridge shaped transverse walking boards 1 with a plurality of guardrails are arranged at two ends on an original assembly station 3, and are fixed with the original assembly station 3 by a plurality of fastening plates 2. The middle part of the arch bridge shaped transverse walking board 1 with the guardrails is provided with a middle door 4 which can be opened and closed, so that the worker can conveniently walk out of and into the arch bridge shaped transverse walking boards 1. A safety rope 5 is fixed between the span of the two arch bridge shaped transverse walking boards 1, the two ends of the safety rope 5 are connected with the rope straining device 6, respectively, which is fixed in the middle of each of the two arch bridge shaped transverse walking boards 1, and the safety rope 5 is strained and straightened by the rope straining device 6. The worker climbs to the roof of the train body 8 that is under construction through the arch bridge shaped transverse walking boards 1, and ties the other end of a safety belt 7 that is tied on him to the safety rope 5, opens and closes the middle doors 4 to walk out of and into the arch bridge shaped transverse walking boards 1, the safety of the worker operating at the working positions of the roof of the train body 8 that is under construction can be guaranteed.

What is claimed is:

1. A safety protection device for the roof construction of a train body assembly, characterized by comprising two arch bridge shaped transverse walking boards fixed to an original assembly station and non-movably fixed with respect to each other and to the original assembly station and a safety rope, wherein the safety rope is fixed between the span of the two arch bridge shaped transverse walking boards with opposite ends of the safety rope being fixed to a respective arch bridge shaped transverse walking board, wherein a middle part of each arch bridge shaped transverse walking board is provided with a middle door, which is used for a worker to walk out of the arch bridge shaped transverse walking boards onto the roof of the train body assembly under construction.

2. The safety protection device for the roof construction of the train body assembly according to claim 1, characterized in that: a rope straining device is fixed in the middle of each of the arch bridge shaped transverse walking boards, two ends of the safety rope are connected with the rope straining device of the two arch bridge shaped transverse walking boards, respectively, and the safety rope is strained and straightened by the rope straining device.

* * * * *